United States Patent [19]

Dolce

[11] Patent Number: 4,769,934

[45] Date of Patent: Sep. 13, 1988

[54] FRAMING DEVICE FOR NEEDLEWORK

[76] Inventor: Frieda Dolce, 9 Apollo La., Hicksville, N.Y. 11801

[21] Appl. No.: 41,455

[22] Filed: Apr. 23, 1987

[51] Int. Cl.[4] ..... G09F 1/12

[52] U.S. Cl. ..... 40/152; 40/642; 40/156; 38/102.91

[58] Field of Search ..... 40/154, 155, 152, 10 R, 40/156, 603; 38/102.91; 160/371, 372

[56] References Cited

U.S. PATENT DOCUMENTS

| | | | |
|---|---|---|---|
| 3,354,560 | 11/1967 | Kuenzel | 40/154 |
| 3,664,049 | 5/1972 | Smith | 40/154 |
| 3,946,863 | 3/1976 | Glasband | 40/152 |
| 4,033,060 | 7/1977 | Lawrence | 40/154 |
| 4,583,309 | 4/1986 | Kane et al. | 40/152 |

*Primary Examiner*—Gene Mancene
*Assistant Examiner*—Wenceslao J. Contreras
*Attorney, Agent, or Firm*—Michael I. Kroll

[57] ABSTRACT

A framing device is provided for needlework consisting of an open structure for encasing and holding the needlework, such as a needlepoint picture on its stretcher bars, between a foldable frame member and backing member.

5 Claims, 1 Drawing Sheet

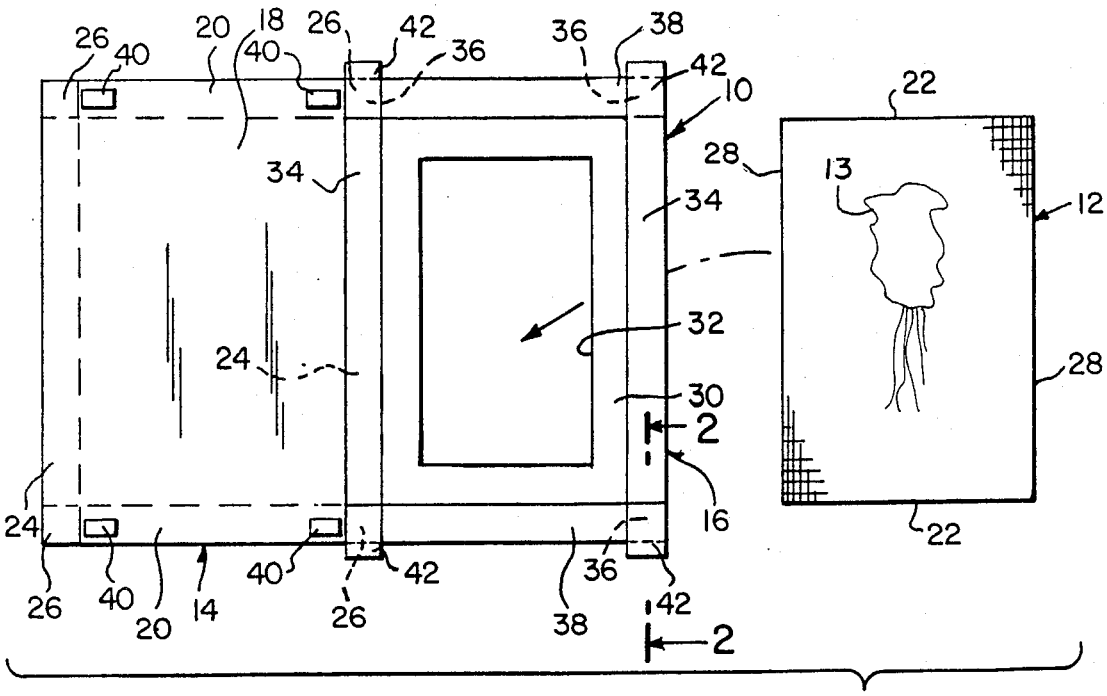
Figure 1
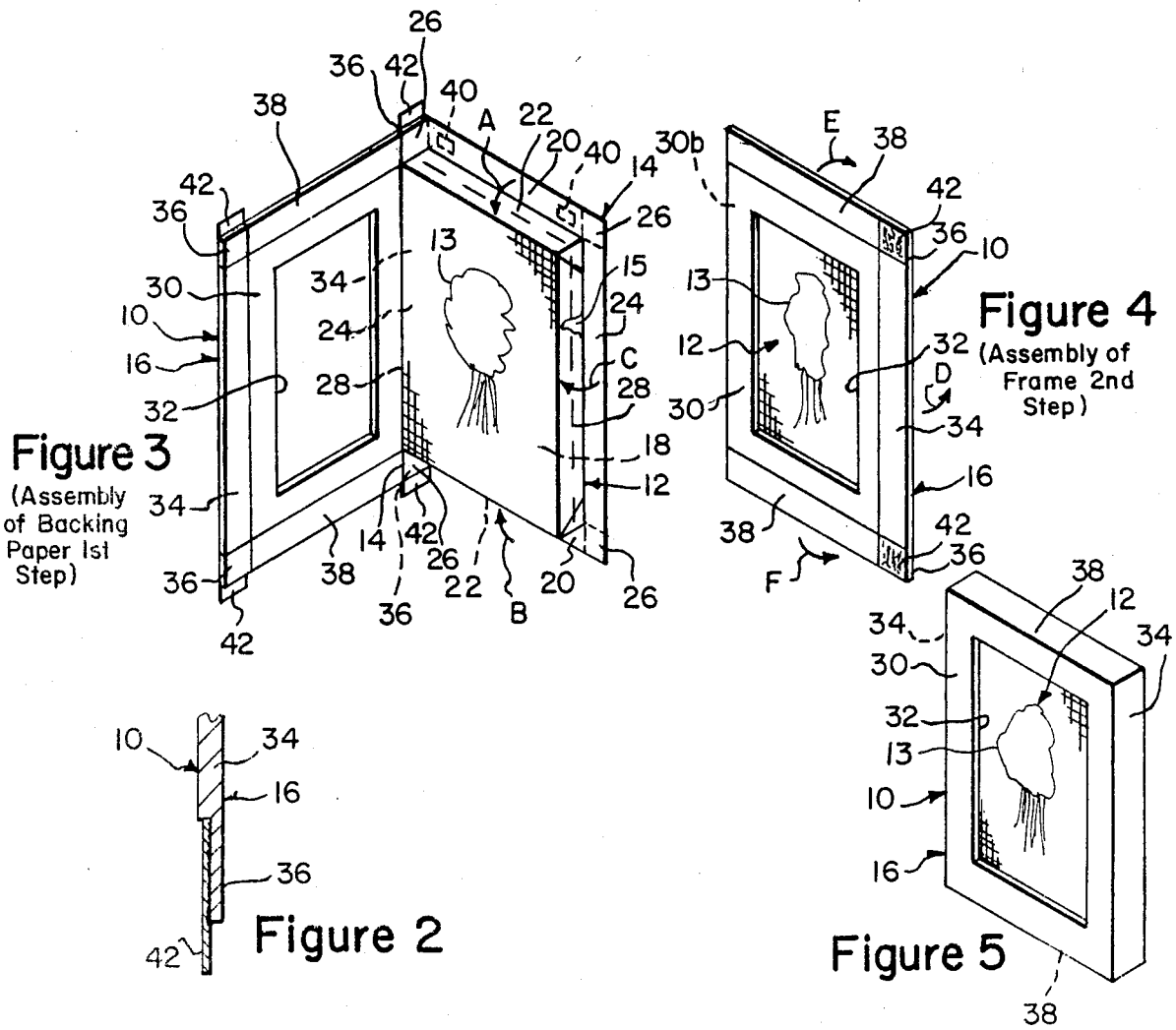
Figure 3
(Assembly of Backing Paper 1st Step)
Figure 4
(Assembly of Frame 2nd Step)
Figure 5
Figure 2

FRAMING DEVICE FOR NEEDLEWORK

BACKGROUND OF THE INVENTION

1. Field of the Invention

The instant invention relates generally to picture frames and more specifically it relates to a framing device for needlework.

2. Description of the Prior Art

Numerous picture frames have been provided in prior art that are adapted to protect, store and display a visual representation or image painted, drawn, photographed, or otherwise rendered on a flat surface. While these units may be suitable for the particular purpose to which they address, they would not be as suitable for the purposes of the present invention as heretofore described.

SUMMARY OF THE INVENTION

All needlepoint work needs to be mounted onto stretcher bars which are approximately three-quarters of an inch square and therefore impossible to frame in a convenient inexpensive manner which makes it necessary to have it framed professionally and accordingly the instant invention provides a low cost framing system.

A primary object of the present invention is to provide a framing device for needlework that will overcome the shortcomings of the prior art devices.

Another object is to provide a framing device for needlework being an open structure for encasing and holding the needlework, such as a needlepoint picture on its stretcher bars between a foldable frame member and backing member.

An additional object is to provide a framing device for needlework that is flat before assembly so that it can be shipped in a box with less of a danger to be damaged by reducing movement within the box.

A further object is to provide a framing device for needlework that is simple and easy to use.

A still further object is to provide a framing device for needlework that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a flat plan view of the invention before installation.

FIG. 2 is a cross sectional view taken along line 2—2 in FIG. 1.

FIG. 3 is a perspective view showing assembly of backing member.

FIG. 4 is a perspective view showing assembly of frame member.

FIG. 5 is a perspective view of the needlework completely assembled within the framing device.

DETAILED DESCRIPTION OF THE PREFERRED EMBODIMENTS

Turning now descriptively to the drawings, in which similar reference characters denote similar elements throughout the several views, FIGS. 1 through 5 illustrate a framing device 10 for needlework 12, such as a needlepoint picture 13 on its stretcher bars 15. The device 10 consists generally of a foldable backing member 14 and a foldable frame member 16 affixed at one side to one side of the backing member 14. In assembly the backing member is first folded in position around the needlework 12. The frame member 16 is then folded in position around the backing member 14 so that the needlework 12 will be encased and sealed between the backing member and the frame member.

The backing member 14 includes a flat sheet 18 being of a size to fit behind the needlework 12. A pair of foldable end portions 20 are provided. One of the end portions is at top and other of the end portions is at bottom of the flat sheet 18. Each of the end portions 20 are of a size to fit over each end 22 of the needlework 12. A pair of foldable side portions 24 are also provided. Each of the side portions has a foldable corner flap 26 and each of the side portions 26 is of a size to fit over each side 28 of the needlework 12 so that each of the corner flaps 26 can bend over each of the folded end portions 20 of the backing member 14.

The frame member 16 includes a flat frame unit 30 that has a window 32 therein. The frame unit 30 is of a size to fit in front of the needlework 12 thus allowing viewing of the needlepoint picture 13 through the window 32. A pair of foldable side portions 34 are provided. Each of the side portions 34 has a foldable recessed corner flap 36. One of the side portions 34 of the frame member 16 is of a size to be affixed to one of the side portions 24 of the backing member 14 while other of the side portions 34 of the frame member 16 is of a size to fit over other folded side portion 24 of the backing member 14 so that the recessed corner flaps 36 can bend over each of the bent corner flaps 26 of the side portions 24 of the backing member 14. A pair of foldable end portions 38 are also provided. One of the end portions is at top and other of the end portions is at bottom of the frame unit 30. Each of the end portions 38 is of a size to fit over one of the folded end portions 20 of the backing member 14 and one of the bent recessed corner flaps 36 of one of the side portions 34 of the frame member 16.

The backing member 14 includes four adhesive pull tabs 40. Each of the pull tabs 40 is affixed to one corner of one of the end portions 20 of the backing member 14 so that when the pull tab 40 is removed exposing the adhesive the corner flap 26 is bent over the folded end portion 20 of the backing member 14 to stick thereto.

The frame member 16 includes four adhesive pull tabs 42. Each of the pull tabs 42 is affixed to one of the recessed corner flaps 36 of each of the side portions 34 of the frame member 16 so that when the pull tab 42 is removed exposing the adhesive the recessed corner flap 36 is bent over the corner flap 26 of the folded side portion 24 of the backing member 14 allowing one of the end portions 38 of the frame member 16 to stick thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A framing device for needlework, said device comprising:

(a) a foldable backing member having a side;

(b) a foldable frame member having only one side bendably affixed to said side of said backing member, said backing member and said frame member forming a compact integral unit;

(c) means for holding said backing member in a folded position around the needlework; and (d) means for holding said frame member in a folded position around said backing member so that the needlework is encased and sealed between said backing member and said frame member.

2. A framing device as recited in claim 1, wherein said backing member includes:

(a) a flat sheet being of a size to fit behind the needlework;

(b) a pair of foldable end portions, one of said end portions at top and other of said end portions at bottom of said flat sheet, each of said end portions being of a size to fit over each end of the needlework; and (c) a pair of foldable side portions, each of said side portions having a foldable corner flap, each of said side portions being of a size to fit over each side of the needlework so that each of the corner flaps can bend over each of said folded end portions of said backing member.

3. A framing device as recited in claim 2, wherein said frame member includes:

(a) a flat frame unit having a window therein, said frame unit being of a size to fit in front of the needlework thus allowing viewing of the needlepoint picture through the window;

(b) a pair of foldable side portions, each of said side portions having a foldable recessed corner flap, one of said side portions of said frame member being of a size to be affixed to one of said side portions of said backing member while other of said side portions of said frame member being of a size to fit over other said folded side portion of said backing member so that each of the recessed corner flaps can bend over each of said bent corner flaps of said side portions of said backing member; and (c) a pair of foldable end portions, one of said end portions at top and other of said end portions at bottom of said frame unit, each of said end portions being of a size to fit over one of said folded end portions of said backing member and one of the bent recessed corner flaps of one of said side portions of said frame member.

4. A framing device as recited in claim 3, wherein said holding means for said backing member includes four adhesive pull tabs, each of said pull tabs affixed to one corner of one of said end portions of said backing member so that when said pull tab is removed the corner flap is bent over said folded end portion of said backing member to stick thereto.

5. A framing device as recited in claim 4, wherein said holding means for said frame member includes four adhesive pull tabs, each of said pull tabs affixed to one of the recessed corner flaps of each of said side portions of said frame member so that when said pull tab is removed the recessed corner flap is bent over said corner flap of said folded side portion of said backing member allowing one of said end portions of said frame member to stick thereto.

* * * * *